US005850672A

United States Patent [19]

Dalton

[11] Patent Number: 5,850,672

[45] Date of Patent: Dec. 22, 1998

[54] APPARATUS OR KIT FOR CLOSING SLIDING CLOSURE

[76] Inventor: Kenneth R. Dalton, 332 S. Huntington, San Dimas, Calif. 91773

[21] Appl. No.: 829,354

[22] Filed: Mar. 31, 1997

[51] Int. Cl.[6] ..... E05F 1/00

[52] U.S. Cl. ..... 16/81; 49/404; 49/387

[58] Field of Search ..... 16/81, 71, 82; 49/404, 387

[56] References Cited

U.S. PATENT DOCUMENTS

| | | | |
|---|---|---|---|
| 3,334,444 | 8/1967 | Hargrove | 49/387 |
| 4,003,102 | 1/1977 | Hawks et al. | 49/404 |
| 4,649,598 | 3/1987 | Kinsey et al. . | |
| 4,884,369 | 12/1989 | Tatham . | |
| 4,891,911 | 1/1990 | Yung | 16/81 |
| 5,579,607 | 12/1996 | Braid | 16/81 |

FOREIGN PATENT DOCUMENTS

| | | | |
|---|---|---|---|
| 1737089 | 5/1992 | U.S.S.R. | 16/81 |
| 8400 | 4/1896 | United Kingdom | 16/81 |

*Primary Examiner*—Chuck Mah
*Attorney, Agent, or Firm*—Boniard I. Brown

[57] ABSTRACT

Apparatus or kit is provided for use in a sliding closure for the automatic return of the sliding closure to its closed position after being moved to an open position, and includes a corner insert member adapted to fit within an upper corner structure of the sliding closure, with pulley mounted thereon, a cable trained about the pulley and attached to a stationary frame with a weight suspended from the cable in a vertical stile of the sliding closure.

12 Claims, 2 Drawing Sheets

APPARATUS OR KIT FOR CLOSING SLIDING CLOSURE

BACKGROUND AND SUMMARY OF THE INVENTION

Door closure systems for sliding closures and doors are well-known. Examples of sliding door closure systems are described in U.S. Pat. Nos. 4,649,598 to Kinsey, et al., and 4,884,369 to Tatham, in which arrangement sliding door closure systems utilize a weight at one end of a cable which extends upwardly over a pulley, with the other end of the cable attached to a mounting frame or the like. When the sliding closure is moved toward its open position, the weight is raised and exerts a closing force via the pulley on the sliding closure, when the door is released. The term "sliding closure" is in general use, although a sliding closure typically rolls on small casters, typically of nylon, and rolls on the track mounted below the sliding closure.

The present invention provides apparatus or a kit for mounting in a sliding closure, typically a screen door, which is disposed in a stationary mounting frame, which closure has spaced vertical stiles and an upper header. A corner insert member, with a pulley mounted thereon in accordance with the invention, is configurated and adapted to fit within an upper corner structure of the sliding closure, and a cable is trained about the pulley, sttached to an upper member of the stationary mounting frame, and has weight means suspended therefrom in one of the vertical stiles. Upon movement of the sliding closure from its closed position, the weight is drawn upwardly toward the pulley, and when the sliding closure is released the weight is gravity-urged downwardly to move the sliding closure toward its closed position. The components according to the invention may be installed during original manufacture, or may be provided in kit form for retrofit insertion after manufacture. With the pulley rotatably mounted on the insert member, which insert member is itself conventional, the entire apparatus including the insert member, pulley, cable, and weight are entirely disposed within a vertical stile and a horizontal header of the sliding closure, and thus are not seen from the exterior, providing a more pleasing appearance.

DESCRIPTION OF THE PREFERRED EMBODIMENT

Figure 1:
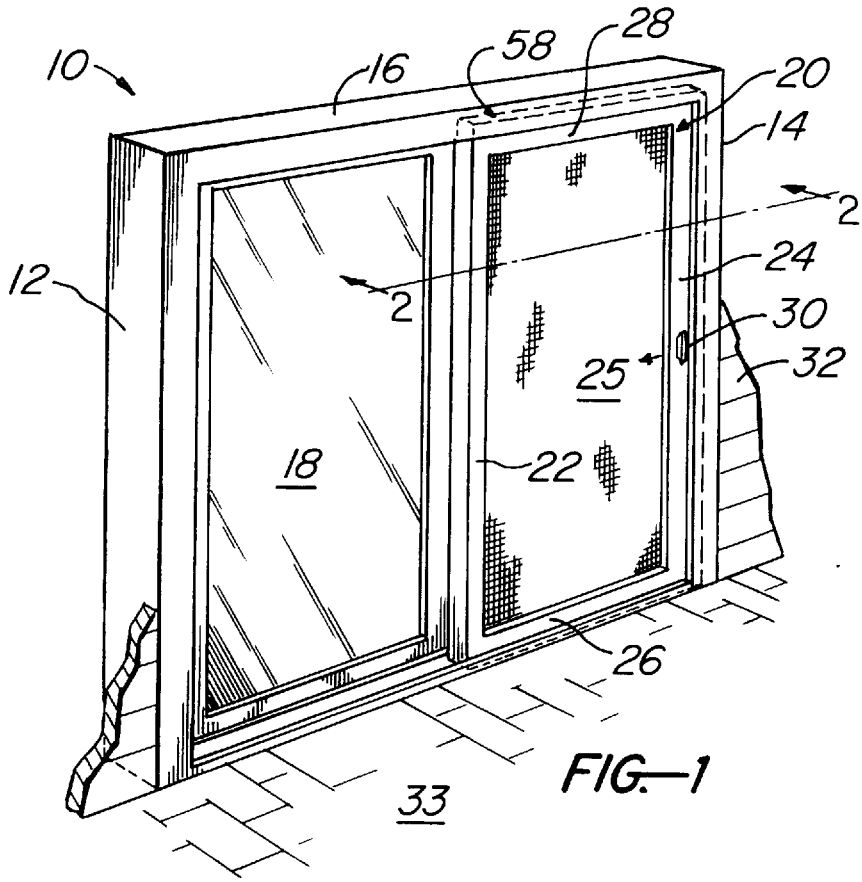
FIG. 1 is a perspective view of a sliding screen door closure mounted in a stationary mounting frame secured on a floor.

Referring to the drawings, a preferred embodiment of the automatic door closure arrangement of the invention comprises components or a kit for installation in a sliding closure or door, typically a screen door, as shown.

Although the invention is herein described in relation to a sliding door closure, typically residential or industrial, it is equally applicable to various sliding closures, including windows, sliding and rolling closures, garage doors, pocket doors, etc.

The embodiment herein described is a simplified arrangement without plural movable panels or plural stationary panels inasmuch as such would not be relevant to the apparatus or kit of the invention, which is shown in a simplified sliding closure arrangement for clarity, although many installations involve two and sometimes more sliding closures along with fixed panels, screens, etc.

Referring to the drawings, the preferred embodiment comprises apparatus or components of a kit for installation in a sliding closure or door.

The overall assembly comprises a doorway frame 10 having first and second vertical jambs 12, 14, and an upper horizontal lintel is extending between the jambs, these components defining a vertical plane. A stationary panel 18 is mounted within the plane and adjacent jamb 12, as shown in FIG. 1.

A movable closure or sliding door assembly 20 includes a rectangular frame comprising generally tubular vertical stiles 22, 24, a bottom leaf 26, a door header or upper leaf 28, and a panel 25, typically a screen. A handle 30 is provided on the right stile 24 for manual grasping to open the sliding closure.

The doorway frame is anchored in a vertical wall 32 of a residential or other building structure. The upper leaf 28 of the sliding closure 20 is received within the rail of the lintel, and the door is slidably mounted by means of rollers (not shown) rolling along a rail in the bottom of the frame, which is securely fixed to a floor 33.

Figure 2:
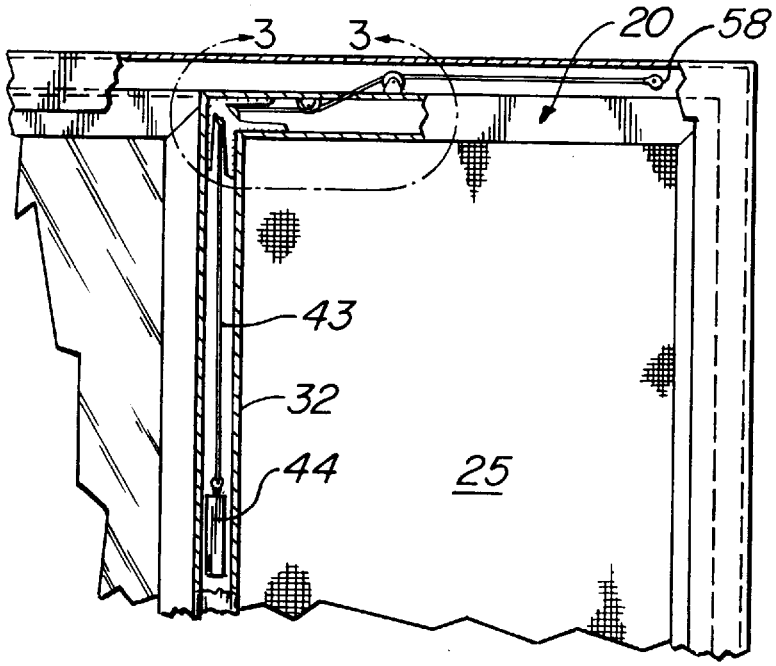
FIG. 2 is a partial elevational view, taken at line 2—2 in FIG. 1 and partially in section, showing the general arrangement of components according to the invention in the sliding closure of FIG. 1.
Figure 4:
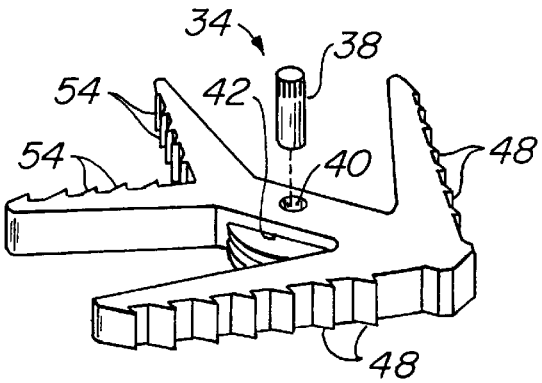
FIG. 4 is an exploded perspective view of a corner insert member and pulley components according to the invention.
Figure 5:
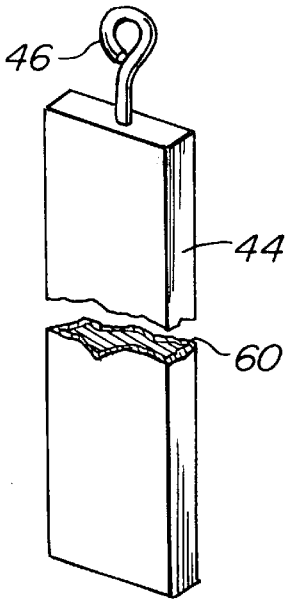
FIG. 5 is a perspective view of the preferred form of weight utilized with the invention.

An automatic door closure kit comprises a corner insert member 34 (FIGS. 2 and 3) wherein is rotatably mounted a grooved pulley 36 mounted on an axle 38 which is force-fitted into registering openings 40 in the insert member. The axle has serrations or grooves therein for better gripping engagement in the openings. The pulley is accommodated by an appropriate slot 42 defined in a mid-portion of the insert member, as shown (FIG. 4). A cable 43 is provided to extend about pulley 36, and a weight 44 is provided to be suspended by the cable downwardly in stile 22, the weight being suspended by an eye component 46 secured in the upper portion of the weight (FIG. 5).

Indentations or teeth 48 are defined in the outer corner-defining surfaces of the insert member which engage the inner surfaces of the walls 50, 52 defining a corner of the sliding closure (FIG. 3), thus to provide improved securement. Similarly, serrations or teeth 54 are defined in the opposite portion of the insert member which defines a male corner portion (FIG. 3), and engage the inner walls of the surfaces of the walls defining a corner between the header and stile 22.

Figure 3:
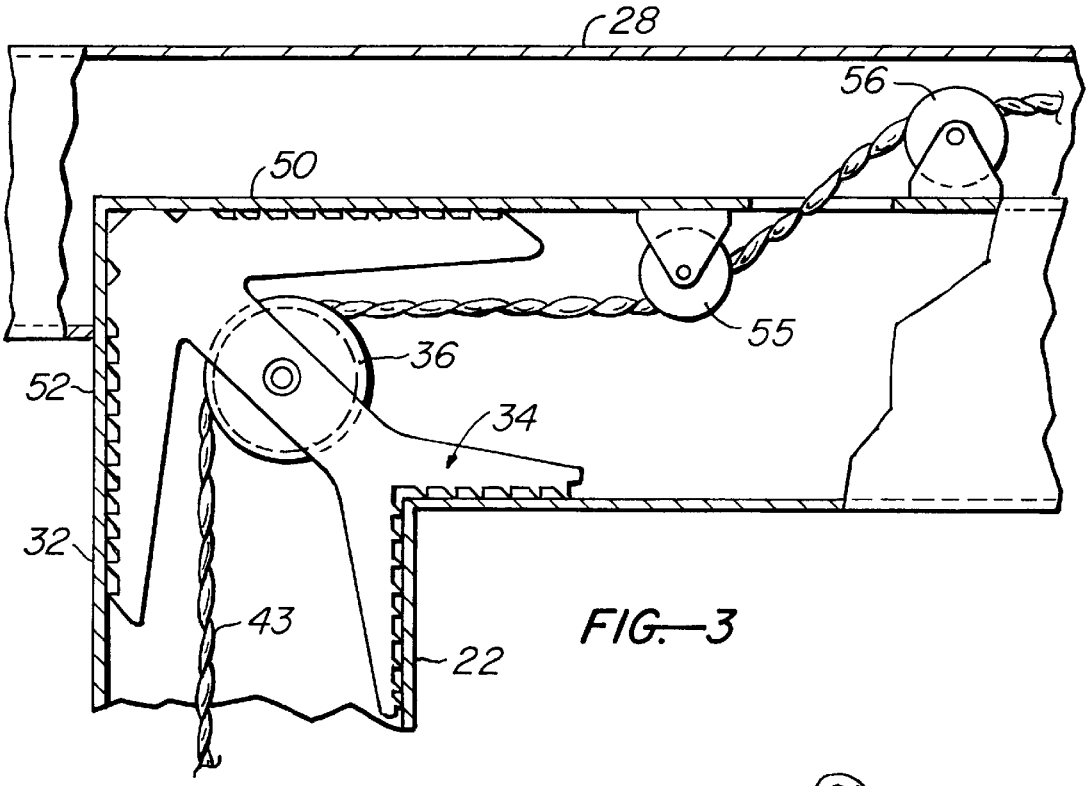
FIG. 3 is an enlarged partial sectional view taken at encircling arrows 3—3 in FIG. 2.

With the insert member pulley 36 and cable 43 installed, the cable is trained over pulley 36 and over a smaller pulley 55 which is rotatably mounted on the inner surface of the upper leaf 28, and a pulley 56 mounted on the outer surface of the wall of the upper leaf 28, as shown in FIG. 3. The end of the cable remote from the pulley is attached to the upper lintel of the door frame at attachment point 58, as by securement about or in an attachment member (not shown).

The weight (FIGS. 2 and 5) is preferably an elongated rectangular block, as shown, and is adapted to position in and to move within the vertical stile 22. The weight has a covering 60 of rubber or other resilient material of about 1/16" thickness on its surfaces other than its end surfaces for the purpose of reducing any noise in the movement of the weight upwardly and downwardly in the stile.

The components or kit according to the invention are installed either during original manufacture of the sliding closure, or may be later retrofitted, without requiring major time and work. All the components are positioned and disposed within the sliding closure and are thus out of sight and not visible from the exterior, thus providing an uncluttered and pleasant appearance.

Prior to the introduction of automatic door closure arrangements, it was necessary to restrict the extent of opening travel of a closure and manually to return it to a closed position. As with certain prior devices, this is not required in the use of apparatus according to the present invention. Upon movement of the sliding closure toward its open position the pulley is laterally displaced, the weight is raised, and horizontal displacement force is applied to the pulley to move the sliding closure toward its closed position. As it moves toward this position, it is slowed by the weight and its direction of the movement is automatically reversed without effort by a person.

Thus there has been shown and described a novel apparatus or kit for closing a sliding closure which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. Apparatus for the automatic return to a closed position of a sliding closure disposed in a stationary mounting frame having spaced-apart tubular vertical stiles and a tubular upper header cooperating with one of the stiles to define a corner structure having interior walls defining inner and outer corners, said apparatus comprising:

a corner insert member configurated and adapted to fit within said corner structure and engage the interior walls adjacent both the inner and outer corners, pulley means rotatably mounted on the corner insert member, a cable trained about the pulley and adapted to be attached to an upper member of the stationary mounting frame, and weight means suspended from the cable, whereby upon movement of the sliding closure from its closed position, the weight means is drawn upwardly toward the pulley, and when the sliding closure is released the weight means is gravity-urged downwardly to move the sliding closure toward its closed position.

2. Apparatus according to claim 1, wherein:

said insert member, pulley, cable and weight are supported by the corner insert member.

3. Apparatus according to claim 1, wherein:

said cable is a woven wire cable.

4. Apparatus according to claim 1, wherein: the sliding closure is a screen door.

5. Apparatus for the automatic return to a closed position of a sliding closure disposed in a stationary mounting frame end having spaced-apart vertical stiles and an upper header, said apparatus comprising:

a corner insert member configurated and adapted to fit within an upper corner structure of said sliding closure, said corner insert member has a projecting head portion adapted to engage the inner surfaces of outer corner-defining walls of said one of the stiles and of the header, and has a recessed tail portion adapted to engage outer surfaces of inner corner-defining walls of said header, and said one of the stiles, pulley means rotatably mounted on the corner insert member, a cable trained about the pulley and adapted to be attached to an upper member of the stationary mounting frame, and weight means suspended from the cable, whereby upon movement of the sliding closure from its closed position, the weight means is drawn upwardly toward the pulley, and when the sliding closure is released the weight means is gravity-urged downwardly to move the sliding closure toward its closed position.

6. Apparatus according to claim 5, wherein:

said weight has surfaces coated with resilient material for noise reduction during movement of the weight in the stile.

7. A kit for installation in a sliding closure mounted in a stationary mounting frame for urging the sliding closure toward its closed position when it is moved to an open position, said kit comprising:

a corner insert member configurated and adapted to fit within an upper corner structure of the sliding closure defined by interior walls of a tubular vertical stile and a tubular horizontal header, and engagable with the inner and outer corners of the corner structure, a pulley mounted on said corner insert member, a cable for extension about said pulley and attachment to an upper member of the stationary mounting frame, and a weight for suspension by the cable from the pulley to move the weight upwardly toward the pulley upon movement of the sliding closure from its closed position and urging the sliding closure toward its closed position when released.

8. A kit according to claim 7, wherein:

the sliding closure is a screen door.

9. A kit according to claim 7, wherein:

said insert member, pulley, cable and weight are adapted to be entirely disposed within said one vertical stile and the horizontal header of the sliding closure.

10. A kit according to claim 7, wherein:

said cable is a woven wire cable.

11. A kit for installation in a sliding closure mounted in a stationary mounting frame for urging the sliding closure toward its closed position when it is moved to an open position, said kit comprising:

a corner insert member configurated and adapted to fit within an upper corner structure of the sliding closure defined by a tubular vertical stile and a horizontal header, said corner insert member has a projecting head portion adapted to engage the inner surfaces of outer corner-defining walls of said one of the stiles and of the header, and has a recessed tail portion adapted to engage outer surfaces of inner corner-defining walls of said header and said one of the stiles, a pulley mounted on said corner insert member, a cable for extension about said pulley and attachment to an upper member of the stationary mounting frame, and a weight for suspension by the cable from the pulley in a tubular vertical stile of the sliding closure, the weight moving upwardly toward the pulley upon movement of the sliding closure from its closed position and urging the sliding closure toward its closed position when released.

12. A kit according to claim 11, wherein:

said weight has surfaces coated with resilient material for noise reduction during movement of the weight in the stile.

* * * * *